US010113127B2

(12) United States Patent
Price

(10) Patent No.: US 10,113,127 B2
(45) Date of Patent: Oct. 30, 2018

(54) PROCESS FOR SEPARATING NITROGEN FROM A NATURAL GAS STREAM WITH NITROGEN STRIPPING IN THE PRODUCTION OF LIQUEFIED NATURAL GAS

(75) Inventor: Brian C. Price, Parker, TX (US)

(73) Assignee: BLACK & VEATCH HOLDING COMPANY, Overland Park, KS (US)

( * ) Notice: Subject to any disclaimer, the term of this patent is extended or adjusted under 35 U.S.C. 154(b) by 1174 days.

(21) Appl. No.: 12/799,061

(22) Filed: Apr. 16, 2010

(65) Prior Publication Data

US 2011/0289963 A1 Dec. 1, 2011

(51) Int. Cl.

| | |
|---|---|
| ***F25J 3/00*** | (2006.01) |
| ***C10L 3/10*** | (2006.01) |
| ***F25J 3/02*** | (2006.01) |
| *F25J 1/00* | (2006.01) |

(52) U.S. Cl.

CPC ..... *C10L 3/105* (2013.01); *F25J 3/0209* (2013.01); *F25J 3/0233* (2013.01); *F25J 3/0257* (2013.01); *F25J 1/0047* (2013.01); *F25J 2200/02* (2013.01); *F25J 2200/04* (2013.01); *F25J 2200/70* (2013.01); *F25J 2200/78* (2013.01); *F25J 2205/04* (2013.01); *F25J 2210/06* (2013.01); *F25J 2215/04* (2013.01); *F25J 2220/62* (2013.01); *F25J 2260/20* (2013.01); *F25J 2270/12* (2013.01); *F25J 2270/66* (2013.01)

(58) Field of Classification Search

CPC ..... F25J 1/0022; F25J 1/0032; F25J 1/0047; F25J 1/0052; F25J 1/0092; F25J 3/0257; F25J 3/0276; F25J 3/0209; F25J 3/0233; F25J 3/0214; F25J 3/0635; F25J 3/066; F25J 3/0615; F25J 2210/06; F25J 2220/62; F25J 2200/70; F25J 2200/78; F25J 2205/02; F25J 2205/04; F25J 2215/60; F25J 2210/60; F25J 2210/62; F25J 2270/66; F25J 1/0212; C10L 3/105

USPC ..... 62/618, 620, 623, 927, 630

See application file for complete search history.

(56) References Cited

U.S. PATENT DOCUMENTS

| | | | |
|---|---|---|---|
| 2,976,695 | A | 10/1961 | Meade |
| 3,191,395 | A | 6/1965 | Maher et al. |
| 3,210,953 | A | 10/1965 | Reed |

(Continued)

FOREIGN PATENT DOCUMENTS

| | | |
|---|---|---|
| JP | 200018049 | 1/2000 |
| JP | 2000018049 | 1/2000 |

(Continued)

OTHER PUBLICATIONS

Gas Processor Suppliers Association (GPSA) Engineering Databook, Section 16 entitled "Hydrocarbon Recovery" p. 16-13 through 16-20, 12th Ed. (copyright 2004).

(Continued)

*Primary Examiner* — Keith Raymond

(74) *Attorney, Agent, or Firm* — Hovey Williams LLP

(57) ABSTRACT

A mixed single refrigerant process for separating a nitrogen gas stream from a natural gas stream containing nitrogen to produce a nitrogen gas stream from a liquefied natural gas stream wherein the separated nitrogen gas stream is used as a refrigerant for the natural gas stream and wherein the mixed refrigerant provides cooling for the process.

8 Claims, 2 Drawing Sheets

(56) References Cited

U.S. PATENT DOCUMENTS 3,271,967 A 9/1966 Karbosky
3,596,472 A * 8/1971 Streich ..... 62/623
3,729,944 A 5/1973 Kelley et al.
3,800,550 A 4/1974 Delahunty
3,915,680 A 10/1975 Crawford et al.
3,932,154 A 1/1976 Coers et al.
4,033,735 A * 7/1977 Swenson ..... 62/612
4,036,028 A 7/1977 Mandrin
4,157,904 A 6/1979 Campbell et al.
4,217,759 A 8/1980 Shenoy
4,249,387 A 2/1981 Crowley
4,278,457 A 7/1981 Campbell et al.
4,311,496 A 1/1982 Fabian
4,411,677 A 10/1983 Pervier et al.
4,525,187 A 6/1985 Woodward et al.
4,584,006 A 4/1986 Apffel
4,662,919 A 5/1987 Davis
4,664,686 A 5/1987 Pahade et al.
4,676,812 A 6/1987 Kummann
4,707,170 A 11/1987 Ayres et al.
4,714,487 A 12/1987 Rowles
4,720,294 A 1/1988 Lucadamo et al.
4,727,723 A 3/1988 Durr
4,869,740 A 9/1989 Campbell et al.
4,878,932 A * 11/1989 Phade et al. ..... 62/620
5,051,120 A * 9/1991 Pahade et al. ..... 62/625
5,148,680 A * 9/1992 Dray ..... 62/646
5,182,920 A 2/1993 Matsuoka et al.
5,275,005 A 1/1994 Campbell et al.
5,351,491 A 10/1994 Fabian
5,377,490 A 1/1995 Howard et al.
5,379,597 A 1/1995 Howard et al.
5,398,497 A 3/1995 Suppes
5,497,626 A 3/1996 Howard et al.
5,502,972 A 4/1996 Howard et al.
5,520,724 A 5/1996 Bauer et al.
5,555,748 A 9/1996 Campbell et al.
5,566,554 A 10/1996 Vijayaraghavan et al.
5,568,737 A 10/1996 Campbell et al.
5,596,883 A 1/1997 Bernhard et al.
5,615,561 A 4/1997 Houshmand et al.
5,657,643 A 8/1997 Price
5,771,712 A 6/1998 Campbell et al.
5,791,160 A 8/1998 Mandler et al.
5,799,507 A 9/1998 Wilkinson et al.
5,881,569 A 3/1999 Campbell et al.
5,890,377 A 4/1999 Foglietta
5,890,378 A 4/1999 Rambo et al.
5,950,453 A 9/1999 Bowen et al.
5,979,177 A 11/1999 Sumner et al.
5,983,664 A 11/1999 Campbell et al.
5,983,665 A 11/1999 Howard et al.
5,992,175 A 11/1999 Yao et al.
6,003,603 A 12/1999 Breivik et al.
6,021,647 A 2/2000 Ameringer et al.
6,023,942 A 2/2000 Thomas et al.
6,035,651 A 3/2000 Carey
6,053,008 A 4/2000 Arman et al.
6,070,430 A 6/2000 McNeil et al.
6,085,546 A 7/2000 Johnston
6,105,390 A 8/2000 Bingham et al.
6,112,550 A 9/2000 Bonaquist et al.
6,182,469 B1 2/2001 Campbell et al.
6,260,380 B1 7/2001 Arman et al.
6,266,977 B1 7/2001 Howard et al.
6,267,286 B1 7/2001 Deschenes et al.
6,295,833 B1 10/2001 Hoffart et al.
6,311,516 B1 11/2001 Key et al.
6,311,519 B1 11/2001 Gourbier et al.
6,330,811 B1 12/2001 Arman et al.
6,363,728 B1 4/2002 Udischas et al.
6,367,286 B1 4/2002 Price
6,401,486 B1 6/2002 Lee et al.
6,405,561 B1 6/2002 Mortko et al.
6,412,302 B1 7/2002 Foglietta
6,425,263 B1 7/2002 Bingham et al.
6,425,266 B1 7/2002 Roberts
6,427,483 B1 8/2002 Rashad et al.
6,438,994 B1 8/2002 Rashad et al.
6,449,982 B1 9/2002 Fischer
6,449,983 B2 9/2002 Pozivil
6,460,350 B2 10/2002 Johnson et al.
6,560,989 B1 5/2003 Roberts et al.
6,578,379 B2 6/2003 Paradowski
6,581,410 B1 6/2003 Johnson et al.
6,662,589 B1 12/2003 Roberts et al.
6,725,688 B2 4/2004 Elion et al.
6,745,576 B1 6/2004 Granger
6,823,691 B2 11/2004 Ohta
6,823,692 B1 11/2004 Patel et al.
6,915,662 B2 7/2005 Wilkinson et al.
6,925,837 B2 8/2005 Eaton
6,945,075 B2 9/2005 Wilkinson et al.
7,051,553 B2 5/2006 Mak et al.
7,069,744 B2 7/2006 Patel et al.
7,100,399 B2 9/2006 Eaton
7,107,788 B2 9/2006 Patel et al.
7,114,342 B2 10/2006 Oldham et al.
7,152,428 B2 12/2006 Lee et al.
7,152,429 B2 12/2006 Paradowski
7,159,417 B2 1/2007 Foglietta et al.
7,191,617 B2 3/2007 Cuellar et al.
7,204,100 B2 4/2007 Wilkinson et al.
7,210,311 B2 5/2007 Wilkinson et al.
7,216,507 B2 5/2007 Cuellar et al.
7,219,513 B1 5/2007 Mostafa
7,234,321 B2 6/2007 Maunder et al.
7,234,322 B2 * 6/2007 Hahn et al. ..... 62/620
7,266,975 B2 9/2007 Hupkes et al.
7,310,972 B2 12/2007 Yoshida et al.
7,316,127 B2 1/2008 Huebel et al.
7,357,003 B2 4/2008 Ohara et al.
7,484,385 B2 2/2009 Patel et al.
7,614,241 B2 11/2009 Mostello
7,644,676 B2 1/2010 Lee et al.
7,713,497 B2 5/2010 Mak
7,793,517 B2 9/2010 Patel et al.
7,818,979 B2 10/2010 Patel et al.
7,841,288 B2 11/2010 Lee et al.
7,856,847 B2 12/2010 Patel et al.
8,505,312 B2 8/2013 Mak et al.
8,549,876 B2 10/2013 Kaart et al.
8,650,906 B2 2/2014 Price et al.
8,671,699 B2 3/2014 Rosetta et al.
2002/0166336 A1 11/2002 Wilkinson et al.
2003/0029190 A1 2/2003 Trebble
2003/0046953 A1 3/2003 Elion et al.
2004/0159122 A1 * 8/2004 Patel et al. ..... 62/620
2005/0056051 A1 3/2005 Roberts et al.
2005/0204625 A1 9/2005 Briscoe et al.
2006/0260355 A1 11/2006 Roberts et al.
2006/0260358 A1 11/2006 Kun
2007/0157663 A1 7/2007 Mak et al.
2007/0231244 A1 10/2007 Shah et al.
2008/0264076 A1 10/2008 Price et al.
2009/0193846 A1 8/2009 Foral et al.
2009/0205367 A1 8/2009 Price
2009/0217701 A1 9/2009 Minta et al.
2010/0043488 A1 2/2010 Mak et al.
2010/0064725 A1 3/2010 Chieng et al.
2010/0132405 A1 6/2010 Nilsen
2011/0289963 A1 12/2011 Price
2012/0000245 A1 1/2012 Currence et al.
2012/0090324 A1 4/2012 Rosetta et al.
2012/0137726 A1 6/2012 Currence et al.
2013/0213807 A1 8/2013 Hanko et al.

FOREIGN PATENT DOCUMENTS

JP 20025398 1/2002
JP 2002005398 1/2002

(56) References Cited

FOREIGN PATENT DOCUMENTS

| | | |
|---|---|---|
| JP | 2003232226 | 8/2003 |
| WO | 2005045338 | 5/2005 |

OTHER PUBLICATIONS

Gas Processors Suppliers Association (GPSA) Engineering Databook, Section 16, "Hydrocarbon Recovery," p. 16-13 through 16-20, 12th ed. (2004).

* cited by examiner

PROCESS FOR SEPARATING NITROGEN FROM A NATURAL GAS STREAM WITH NITROGEN STRIPPING IN THE PRODUCTION OF LIQUEFIED NATURAL GAS

FIELD OF THE INVENTION

The present invention comprises a mixed single refrigerant process for separating a nitrogen gas stream from a natural gas stream containing nitrogen to produce a nitrogen gas stream and a liquefied natural gas stream wherein the separated nitrogen gas stream is used as a refrigerant for the natural gas stream and wherein the mixed refrigerant provides cooling for the process.

BACKGROUND OF THE INVENTION

Natural gas is desirable for use as a fuel for use to heat buildings, to supply heat for industrial processes, for the production of electricity, for use as a raw material for various synthesis processes to produce olefins, polymers and the like.

Natural gas is found in many areas which are remote from users of the natural gas. Since the natural gas is not readily transported as a gas, it is frequently liquefied for transportation in this more compact form.

A frequently occurring material in natural gas, which is also produced as a liquid when the natural gas is liquefied, is nitrogen. The nitrogen is also produced as a liquid but since it has a somewhat lower boiling point than liquefied natural gas (LNG), it frequently boils off after the liquefied gas is produced and stored. This can be a problem in that it takes a substantial period of time to remove a substantial amount of liquefied nitrogen from the bulk of the liquid comprising liquid natural gas and liquid nitrogen. Further the presence of the liquid nitrogen in the natural gas may result in difficulty in meeting specifications for the LNG. Accordingly, considerable effort has been devoted to the development of means for removing liquefied nitrogen present in LNG.

Various processes for the liquefaction of natural gas are known. Some such processes include U.S. Pat. No. 4,033,735 issued Jul. 5, 1977 to Leonard K. Swenson (Swenson) which is hereby incorporated in its entirety by reference. In such processes, a single mixed refrigerant is used. These processes typically use a mixture of gases to produce a single mixed refrigerant which can be compressed and liquefied to produce a refrigerant at a very low temperature, i.e., minus −230° F. to −275° F. or lower. The mixed refrigerant is passed into a heat exchanger and passed from a heat exchanger inlet, through the heat exchanger to an expansion valve at an outlet end of the heat exchanger and then directed back into the heat exchanger as vaporized and at the lower temperature. This stream is typically a continuously vaporizing stream as it passes back through the heat exchanger to the inlet end. The natural gas stream to be cooled is passed through the heat exchanger from its inlet end to its outlet in heat exchange with the vaporizing single mixed refrigerant. The spent refrigerant is then recovered, recompressed and re-expanded in the heat exchanger.

Another single mixed refrigerant process is shown in U.S. Pat. No. 5,657,643 issued Aug. 19, 1997 to Brian C. Price (Price) which is hereby incorporated in its entirety by reference.

Typically where the natural gas has contained substantial amounts of nitrogen; for instance, up to as high as 50 volume percent or more, then the liquid nitrogen is typically recovered with the liquid natural gas and allowed to boil off to the atmosphere or recovered for use. The LNG then, freed of a substantial portion of the nitrogen, is adjusted as necessary to have the desired properties for marketing as a fuel or other use.

A second type of process which has been used is illustrated by U.S. Pat. No. 3,855,810 issued Dec. 24, 1974 to Simon, et al (Simon) which is hereby incorporated in its entirety by reference. This patent shows a cascade type process. In such processes, a plurality of refrigeration zones in which refrigerants of decreasing boiling points are vaporized to produce a coolant, are used. In such systems, the highest boiling refrigerant, alone or with other refrigerants, is typically compressed, condensed and separated for cooling in a first refrigeration zone. The compressed, cooled highest boiling point refrigerant is then flashed to provide a cold refrigerant stream used to cool the compressed highest boiling point refrigerant in the first refrigeration zone. In the first refrigeration zone, some of the lower boiling refrigerants may also be cooled and subsequently condensed and passed to vaporization to function as a coolant for a second subsequent refrigeration zone and the like.

With either process, the produced LNG typically contains nitrogen in the LNG. The nitrogen is typically "flashed" off with methane from the LNG. The gas flashed off (flash gas) contains methane and nitrogen in widely varying proportions; however, methane is inevitably lost from the LNG. The flash gas may be used as a low BTU heating gas, passed to methane or nitrogen recovery, or both, or vented to the atmosphere. It would be desirable to produce the LNG with a no or very low nitrogen content.

A continuing effort to discover such a process has been directed toward this goal.

SUMMARY OF THE INVENTION

The present invention comprises, a single mixed refrigerant process for separating a nitrogen gas stream from a natural gas stream containing nitrogen to produce the nitrogen gas stream and a liquefied natural gas stream in a single process, the process consisting essentially of: cooling the natural gas stream in a single mixed refrigerant heat exchanger to produce a cooled stream; passing the cooled natural gas stream into a separator and recovering a concentrated methane rich liquid stream and a concentrated nitrogen rich vapor stream from the separator; further cooling at least a portion of the concentrated methane rich liquid in the heat exchanger and recovering a first liquefied natural gas stream from the heat exchanger; passing the first liquefied natural gas stream to a nitrogen stripping column; passing the concentrated nitrogen vapor stream to the nitrogen stripping column; recovering a product liquefied natural gas from a lower portion of the nitrogen stripping column; and, recovering an overhead nitrogen stream from near the top of the nitrogen stripping column and passing the overhead nitrogen stream to the heat exchanger as a refrigerant.

The separator used in the process may be either a flash vessel or a high pressure distillation column.

DESCRIPTION OF PREFERRED EMBODIMENTS

In the discussion of the Figures, the same numbers will be used throughout to refer to the same or similar components.

Figure 1:
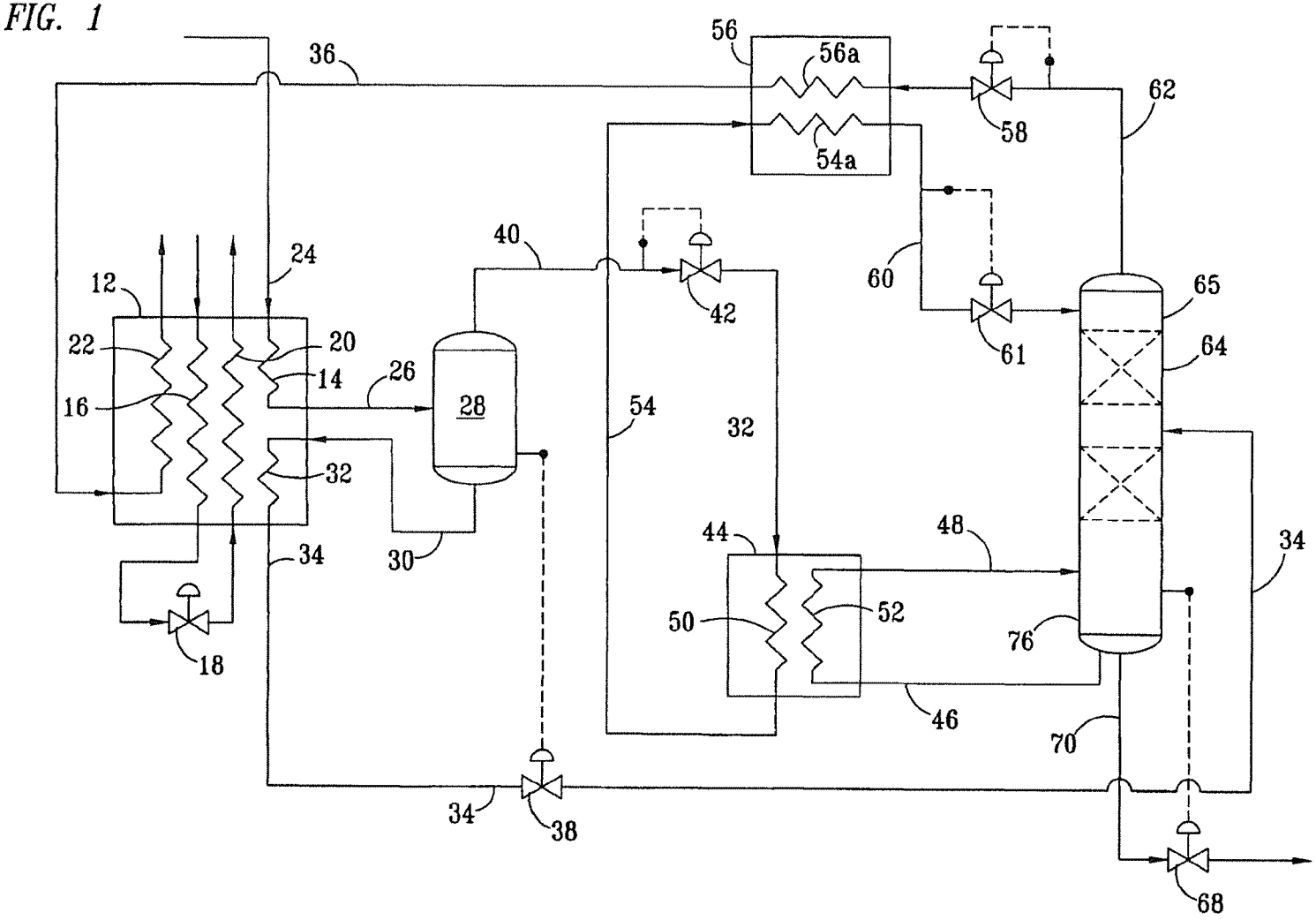
FIG. 1 is a schematic diagram of an embodiment of the process of the present invention; and, FIG. 2 is a schematic diagram of an alternate embodiment of the process of the present invention.

In FIG. 1, a single mixed refrigerant heat exchanger 12 is shown and includes a heat exchange passageway 14 through which a nitrogen-containing natural gas stream originating in line 24 is passed to a line 26 for withdrawing all or a portion of the natural gas stream and passing it to a flash vessel 28. A methane-rich bottom stream 30 is returned from flash vessel 28 to a heat exchange passageway 32 in heat exchanger 12. A liquid or semi-liquid natural gas stream is withdrawn from heat exchanger 12 through a line 34 at a temperature from about −24020 F. to about −250° F. and typically at a pressure from about 350 psia to about 500 psia.

A heat exchange passageway 16 is used to cool a mixed refrigerant, which as shown in Price may contain materials selected from a group consisting of nitrogen and hydrocarbons containing from about 1 to about 5 carbon atoms. This stream is cooled and passed from heat exchanger 12 through an expansion valve 18 where the cooled mixed refrigerant is at least partially vaporized and passed back into heat exchanger 12 through a heat exchange passageway 20 through which it is passed to recompression and recycle to line 16. A nitrogen stream at a temperature from about −295 to about −310° F. is passed to heat exchanger 12 via a line 36 and passes through heat exchange passageway 22 as a refrigerant in heat exchanger 12. This stream of nitrogen, which may contain small quantities of methane (<10 volume percent) may be discharged at near ambient temperature to the atmosphere, with or without further treatment as may be required. This stream as discharged may be used as a source of nitrogen and is typically at ambient temperature at about 15 psia.

The stream withdrawn from heat exchanger 14 through line 26 is passed to flash vessel 28 at a temperature sufficiently low that a separation can be accomplished to produce a concentrated methane rich liquid stream via a line 30 and a concentrated nitrogen rich vapor stream via a line 40 (about −180 to about −210° F. and about 350 to about 500 psia. The concentrated nitrogen rich vapor stream in line 40 is passed through an expansion valve 42 to produce a stream having a temperature from about −230° F. to about −250° F. This stream is passed through a reboiler 44 for a distillation column 64 where it is passed through a heat exchange passageway 50 in heat exchange with a bottom steam 46 from a nitrogen stripping column 64. Stream 46 is passed from near a bottom of column 64 to a heat exchange passageway 52 in reboiler 44 and then back into column 64 via a line 48. The concentrated nitrogen rich vapor stream in line 54 from line 40 is passed to heat exchange through a reflux heat exchanger 56 and then via a line 60 which includes a control valve 61 to control the flow through line 60 to the upper portion of column 64.

Reflux heat exchanger 56 includes a heat exchange passageway 54*a* for the concentrated nitrogen rich vapor stream and a heat exchange passageway 56*a* for passage of the nitrogen stream recovered via a line 62 from column 64. A control valve 58 in line 62 controls the pressure from column 64. This nitrogen stream 62 is passed through a reflux exchanger 56 and then to heat exchanger 12 where it is introduced and passed through the nitrogen heat exchange passageway 22 to discharge at approximately ambient temperature. This allows the use of the recovered nitrogen, which is recovered at a low temperature, to be used as a source of cooling refrigerant rather than simply exhausted to the atmosphere or used for heat exchange applications which recover less of the cooling value of the nitrogen stream.

The bottom stream from flash vessel 28 is returned to heat exchanger 12 through a line 30 and further cooled in a heat exchange path 32 in heat exchanger 12. This stream 34 then passes through the control valve 38 and is passed to a middle portion of column 64 and distilled to produce LNG containing reduced quantities of nitrogen (less than ten percent).

A significant separation has occurred in flash vessel 28 and further separation occurs in the upper portion 65 and lower portion 76 of column 64. The produced LNG is recovered via a line 70 which includes a control valve 68.

Typically the column operates at a pressure from about 20 to about 50 psia and produces an overhead stream of nitrogen with less than 10 volume percent methane, and desirably less than about 5 volume percent methane. The bottom stream composition is controlled by stripping column reboiler 44 and will usually contain from 1 to 3 volume percent nitrogen. This product is sent to LNG storage.

According to one embodiment of this invention, the nitrogen is separated from the methane as part of the liquefaction unit to produce LNG and a separated nitrogen stream from a single mixed refrigerant production process. No methane vapor is produced unless desired for fuel. This type of unit is much more efficient as the nitrogen is removed in the LNG production unit so that a nitrogen rejection unit is not required and the compression required for a nitrogen rejection unit is not necessary. Further by the use of this process, the cooling values in the nitrogen stream as separated are recovered in a heat exchanger thereby improving the efficiency of the heat exchange portion of the process.

Figure 2:
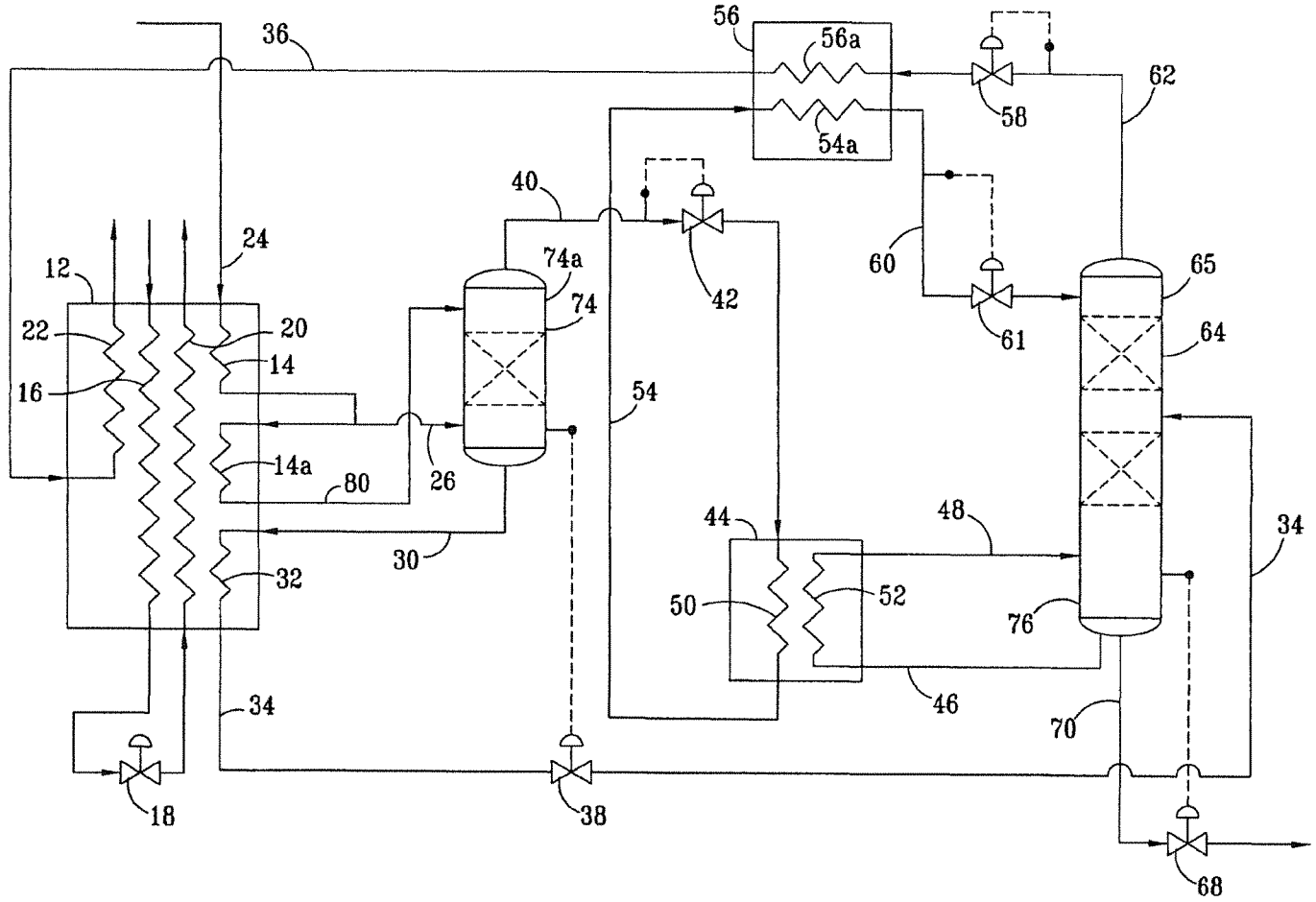

When the feed stream contains lower amounts of nitrogen, i.e., lower than 15 volume percent, the process variation shown in FIG. 2 may be employed to reduce the nitrogen content of the LNG and minimize methane loss in the rejected nitrogen stream. A feedstream is passed to a distillation vessel 74 through a line 26 from heat exchanger 12, as in FIG. 1.

In FIG. 2, a stream 26*a* is withdrawn from line 26 (about −165 to about to about 195° F., at about 350 to about 500 psia) and passed through a section of heat exchanger path 14, shown as 14*a*, and passed via a line 80 to an upper portion 74*a* of a distillation vessel 74. The overhead stream 40 (concentrated nitrogen rich stream), recovered from vessel 74 is passed through a control valve 42 where its temperature is further reduced to from about −230° F. to about −250° F. This stream is then passed through a heat exchange passageway 50 in a reboiler 44 and is recovered as a further cooled stream in line 54 and passed to heat exchange passageway 54*a* in a reflux heat exchanger 56 and then via a control valve 61 and a line 60 into an upper portion 65 of a nitrogen stripper column 64.

The bottom stream from distillation vessel 74 is passed through a line 30 to a heat exchange passageway 32 in heat exchanger 12 to produce a concentrated methane stream in line 34. The methane stream in line 34 is passed to nitrogen distillation vessel 64 and is eventually recovered through line 70 with the flow being regulated through a valve 68.

By the use of the process of FIG. 2, lower nitrogen contents can be achieved by comparison to those results achieved by the process of FIG. 1 with the lower nitrogen content feedstreams. Not only does the process of the present invention produce a low nitrogen LNG product, it also produces a stream of nitrogen with a small quantity of methane (less than three volume percent methane).

The variations in FIG. 2 show that a nitrogen stream with reduced methane can be produced even when a lower nitrogen feedstock is used. This improvement is accomplished because the product liquid from the distillation column is less concentrated in nitrogen than it is in the process of FIG. 1 using a flash vessel. This difference in composition is also beneficial in the operation of the nitrogen stripping column.

As well known to the art, if the feed gas contains significant heavy hydrocarbons that would solidify in the LNG process, additional chilling and separation steps are undertaken to remove these heavy hydrocarbons before chilling to the flash vessel temperature.

Contrast prior art LNG processes which produce most of the nitrogen in the feed natural gas in the LNG for recovery in subsequent flashing or other downstream processes. Such recovery requires either more energy to operate the recovery process or valuable product loss (methane) by flashing. The flashed gases will typically contain nitrogen and methane which are expensive to separate or otherwise recovery separately.

The present process produces the LNG at a low nitrogen content initially. There is no need to flash or otherwise treat the LNG product to reduce the nitrogen content and no gaseous methane is intentionally produced by this process. All the cooling values for the process are initially supplied by the single mixed refrigerant. A portion of the cooling values initially supplied are recovered from the separated nitrogen returned to the single mixed refrigerant heat exchanger as a refrigerant. The process refrigeration values are supplied by the single mixed refrigerant. The nitrogen is recovered by separation at a suitable temperature from an existing process stream and separated by distillation from a distillation column 64 wherein the cooling values required are supplied by the LNG. The process produces low nitrogen LNG without an additional energy requirement and without the loss of valuable product (LNG) after production.

While the present invention has been described by reference to certain of its preferred embodiments, it is pointed out that the embodiments described are illustrative rather than limiting in nature and that many variations and modifications are possible within the scope of the present invention. Many such variations and modifications may be considered obvious and desirable by those skilled in the art based upon a review of the foregoing description of preferred embodiments.

What is claimed is:

1. A process for producing liquefied natural gas from a nitrogen-containing natural gas stream, the process comprising:

a) cooling a stream of mixed refrigerant in a first heat exchanger of a single closed-loop mixed refrigerant system to provide a cooled mixed refrigerant stream;
b) expanding at least a portion of the cooled mixed refrigerant stream to produce an expanded mixed refrigerant stream;
c) cooling and at least partially condensing the natural gas stream in a first heat exchange passageway via indirect heat exchange with the expanded mixed refrigerant stream in the first heat exchanger to produce a cooled natural gas stream;
d) dividing the cooled natural gas stream withdrawn from the first heat exchange passageway into a first portion and a second portion;
e) introducing the first portion into a lower inlet of a first vapor-liquid separator;
f) subsequent to said dividing, subcooling the second portion in the first heat exchanger to provide a subcooled liquid portion, wherein said subcooling is carried out in a second heat exchange passageway via indirect heat exchange with said expanded mixed refrigerant;
g) subsequent to said subcooling, introducing the subcooled liquid portion into an upper inlet of the first vapor-liquid separator, wherein the upper inlet of the first vapor-liquid separator is located at a higher vertical elevation than the lower inlet;
h) withdrawing a methane rich liquid bottoms stream and a first nitrogen rich vapor overhead stream from the first vapor-liquid separator;
i) further cooling the methane rich liquid bottoms stream in the first heat exchanger in a third heat exchange passageway to provide a first liquid natural gas stream;
j) introducing at least a portion of the first liquid natural gas stream into an inlet of a nitrogen stripping column;
k) introducing at least a portion of the first nitrogen rich vapor overhead stream into another inlet of the nitrogen stripping column;
l) withdrawing a stream of nitrogen-depleted liquefied natural gas (LNG) from a lower portion of the nitrogen stripping column, wherein the LNG comprises less than 3 volume percent nitrogen;
m) recovering an overhead nitrogen rich vapor stream from a location near the top of the nitrogen stripping column, wherein the overhead nitrogen rich vapor stream comprises less than 3 volume percent methane;
n) introducing the overhead nitrogen rich vapor stream into the first heat exchanger; and
o) using at least a portion of the overhead nitrogen rich vapor stream as a refrigerant in the first heat exchanger to carry out at least a portion of the cooling of step (a) and/or at least a portion of the cooling of step (c), wherein the single closed-loop mixed refrigerant system is the only closed-loop refrigeration system used to cool the natural gas stream.

2. The process of claim 1, wherein the first nitrogen rich vapor overhead stream is withdrawn from the first vapor-liquid separator and cooled via indirect heat exchange with a fluid stream withdrawn from a lower portion of the nitrogen stripping column in a nitrogen stripping column reboiler.

3. The process of claim 2, wherein the first nitrogen rich vapor overhead stream withdrawn from the nitrogen stripping column reboiler is further cooled by heat exchange with the overhead nitrogen rich vapor stream withdrawn from the nitrogen stripping column.

4. The process of claim 1, wherein the first vapor-liquid separator is a distillation column.

5. The process of claim 1, wherein the cooling of step (c) further provides a vaporized stream of mixed refrigerant; further comprising, compressing the vaporized stream of mixed refrigerant to provide a stream of compressed mixed refrigerant, wherein the stream of mixed refrigerant cooled in step (a) comprises the stream of compressed mixed refrigerant.

6. A system for liquefying a nitrogen-containing natural gas stream to provide an LNG product, the system comprising:

a first heat exchanger comprising a first heat exchange passageway and a second heat exchange passageway for cooling at least a portion of the natural gas stream and a nitrogen heat exchange passageway for warming a nitrogen-rich fluid stream, wherein the first heat exchange passageway comprises a warm natural gas inlet for receiving a vapor-phase natural gas feed stream and a cooled natural gas outlet for discharging the cooled natural gas stream, wherein the second heat exchange passageway comprises a cool natural gas inlet and a further cooled natural gas outlet for discharging a subcooled natural gas stream, and the nitrogen heat exchange passageway comprises a cool nitrogen inlet and a warmed nitrogen outlet;

a first cooled natural gas conduit having a first cooled gas inlet and a first cooled gas outlet, wherein the first cooled gas inlet is in fluid flow communication with the cooled natural gas outlet of the first heat exchange passageway and the first cooled gas outlet is in fluid flow communication with the cool natural gas inlet of the second heat exchange passageway;

a second cooled natural gas conduit having a second cooled gas inlet and a second cooled gas outlet, wherein the second cooled gas inlet is in fluid flow communication with the cooled natural gas outlet of the first heat exchanger;

a first vapor-liquid separator for separating at least a portion of the cooled natural gas stream into a nitrogen-rich vapor stream and a methane-rich liquid stream, wherein the first vapor-liquid separator comprises a first lower fluid inlet, a first upper fluid inlet, a first vapor outlet, and a first liquid outlet, wherein the first lower fluid inlet is positioned at a lower vertical elevation than the first upper fluid inlet, wherein the first lower fluid inlet is in fluid flow communication with the second cooled gas outlet of the second cooled natural gas conduit and the first upper fluid inlet is in fluid flow communication with the further cooled natural gas outlet of the second heat exchange passageway;

a second heat exchanger comprising a third heat exchange passageway for cooling at least a portion of the nitrogen-rich vapor stream withdrawn from the first vapor-liquid separator, wherein the third heat exchange passageway comprises a warm nitrogen-rich inlet and a cooled nitrogen-rich outlet, wherein the warm nitrogen-rich inlet is in fluid flow communication with the first vapor outlet of the first vapor-liquid separator;

a second vapor-liquid separator comprising a second upper fluid inlet, a second lower fluid inlet, a second vapor outlet, and a second liquid outlet, wherein the second upper fluid inlet is in fluid flow communication with the cooled nitrogen-rich outlet of the third heat exchange passageway, wherein the second lower fluid inlet of the second vapor-liquid separator is in fluid flow communication with the first liquid outlet of the first vapor-liquid separator, wherein the second vapor outlet is in fluid flow communication with the cool nitrogen inlet of the nitrogen heat exchange passageway disposed in the first heat exchanger; and a single closed-loop mixed refrigerant system comprising— a first refrigerant heat exchange passageway disposed within the first heat exchanger for cooling a stream of mixed refrigerant, wherein the first refrigerant heat exchange passageway comprises a warm refrigerant inlet and a cooled refrigerant outlet;

an expansion device for expanding the stream of cooled mixed refrigerant, wherein the expansion device comprises a high pressure fluid inlet and a low pressure fluid outlet, wherein the high pressure fluid inlet of the expansion device is in fluid flow communication with the cooled refrigerant outlet of the first refrigerant heat exchange passageway; and a second refrigerant heat exchange passageway disposed within the first heat exchanger for warming the expanded stream of mixed refrigerant, wherein the second refrigerant heat exchange passageway comprises a cooled refrigerant inlet and a warmed refrigerant outlet, wherein the cooled refrigerant inlet is in fluid flow communication with the low pressure outlet of the expansion device, wherein the second refrigerant heat exchange passageway is configured to facilitate heat transfer between a stream of expanded mixed refrigerant in the second refrigerant heat exchange passageway and the streams passing through the first and second heat exchange passageways, wherein the single closed-loop mixed refrigerant system is the only closed-loop mixed refrigeration system for cooling the natural gas stream.

7. The system of claim 6, further comprising a third heat exchanger for further cooling at least a portion of the cooled-nitrogen rich stream withdrawn from the cooled nitrogen-rich outlet of the third heat exchange passageway of the second heat exchanger, wherein the third heat exchanger comprises a fourth heat exchange passageway and a fifth heat exchange passageway, wherein the fourth heat exchange passageway includes a warm nitrogen-rich fluid inlet and a cool nitrogen-rich fluid outlet and the fifth heat exchange passageway includes a cool nitrogen-rich gas inlet and a warm nitrogen-rich gas outlet, wherein the warm nitrogen-rich fluid inlet is in fluid flow communication with the cooled nitrogen-rich outlet of the third heat exchange passageway and the cool nitrogen-rich fluid outlet is in fluid flow communication with the second upper fluid inlet of the second vapor-liquid separator, wherein the cool nitrogen-rich gas inlet of the fifth heat exchange passageway is in fluid flow communication with the second vapor outlet of the second vapor-liquid separator and the warm nitrogen-rich gas outlet is in fluid flow communication with the cool nitrogen inlet of the nitrogen heat exchange passageway disposed in the first heat exchanger.

8. The system of claim 6, wherein the first vapor-liquid separator is a distillation column.

* * * * *